US007598970B2

(12) United States Patent
Thebault et al.

(10) Patent No.: US 7,598,970 B2
(45) Date of Patent: Oct. 6, 2009

(54) METHOD AND DEVICE FOR PROCESSING VIDEO PICTURES

(75) Inventors: Cédric Thebault, Villingen-Schwenningen (DE); Carlos Correa, Villingen-Schwenningen (DE); Rainer Zwing, VS-Villingen (DE)

(73) Assignee: Thomson Licensing, Boulogne Billancourt (FR)

( * ) Notice: Subject to any disclaimer, the term of this patent is extended or adjusted under 35 U.S.C. 154(b) by 556 days.

(21) Appl. No.: 11/605,995

(22) Filed: Nov. 29, 2006

(65) Prior Publication Data

US 2007/0139305 A1 Jun. 21, 2007

(30) Foreign Application Priority Data

Dec. 20, 2005 (EP) ..... 05292769

(51) Int. Cl.
*G09G 5/10* (2006.01)

(52) U.S. Cl. ..... 345/690; 345/89

(58) Field of Classification Search ..... 345/89, 345/596, 598, 599, 690
See application file for complete search history.

(56) References Cited

U.S. PATENT DOCUMENTS 5,216,417 A 6/1993 Honda et al.
5,777,599 A 7/1998 Poduska, Jr. et al.
6,661,470 B1 * 12/2003 Kawamura et al. ..... 348/699
6,714,250 B1 * 3/2004 Correa et al. ..... 348/447
7,184,053 B2 * 2/2007 Correa et al. ..... 345/589
2003/0206185 A1 * 11/2003 Thebault et al. ..... 345/690
2004/0160455 A1 * 8/2004 Weitbruch et al. ..... 345/596

FOREIGN PATENT DOCUMENTS

EP 0982708 3/2000
EP 982708 A1 * 3/2000
EP 1262947 A1 * 12/2002

OTHER PUBLICATIONS

Search Report dated May 12, 2006.

* cited by examiner

*Primary Examiner*—Amare Mengistu
*Assistant Examiner*—Dmitriy Bolotin
(74) *Attorney, Agent, or Firm*—Robert D. Shedd; Jeffrey M. Navon

(57) ABSTRACT

The invention relates to a method for processing video pictures data for display on a display device having a plurality of luminous elements corresponding to the pixels of a video picture. The invention is related to every kind of display devices based on the principle of duty cycle modulation (pulse width modulation) of light emission and comprising a data driver. The aim of this method is to reduce the data driver overheating by optimizing the dithering of the pixel values of the video pictures. According to the invention, the pixel values used for dithering are chosen for reducing the state changes between successive bits of subfield code words of adjacent luminous elements.

10 Claims, 6 Drawing Sheets

METHOD AND DEVICE FOR PROCESSING VIDEO PICTURES

This application claims the benefit, under 35 U.S.C. § 119 of EP of EP Patent Application 05292769.6 filed 20 Dec. 2005.

FIELD OF THE INVENTION

The invention relates to a method for processing video pictures data for display on a display device having a plurality of luminous elements corresponding to the pixels of a video picture, the luminous elements being organized in columns and lines, wherein the time of a video frame or field is divided into a plurality of sub-fields during which the luminous elements can be activated for light emission, a sub-field code word corresponding to said plurality of sub-fields being used for encoding the pixels values in which each bit can have either an "OFF" state or an "ON" state such that each luminous element is activated during a subfield when the corresponding bit of sub-field code word has an "ON" state.

The invention is related to every kind of display devices based on the principle of duty cycle modulation (pulse width modulation) of light emission and comprising at least a data driver.

BACKGROUND OF THE INVENTION

FIG. 1 illustrates the actual structure of a Plasma Display Panel, called hereinafter PDP. Video is sent to a digital board 10 including a PDP controller. This controller is an integrated circuit (IC) that takes care of all PDP relevant signal processing and converts video information into sub-field information. This controller is responsible for sending all power signals to data drivers 11, line drivers 12 and a common part 13 of the PDP. Line drivers 12 are responsible for selecting, one by one, the lines of cells to be written. Data drivers 11 are responsible for sending bits (0 or 1) on the vertical electrodes of all cells of the current selected lines. Finally, the common part 13 is responsible for generating global signals in combination with line drivers 12 like sustain signals, erase signals, priming signals . . . A PDP cell is present at the crossing point between a vertical electrode coming from a data driver output, a horizontal electrode coming from a line driver output and a horizontal electrode coming from the common part.

As illustrated by FIG. 2, each data driver 11 works as a serial to parallel converter. For a data driver with n outputs, the n data samples Cn,t for a line t are sent serially from the PDP controller 10 to said data driver. The input works at a frequency defined by a clock circuit. On each starting edge of an enable signal ENA, the n outputs of the data driver take the n last input values. In fact when the data Cn,t are sent to the input of the data driver, the outputs take the values Cn,t−1. The enable signal is included in the addressing signal used to activate the current line t−1. The important point is that the input signals are control logic signals (low voltage) whereas the output signals are power signal (high voltage≈60V). The global activity of the data driver is defined by two main parameters:

- the number of changes occurring at the input of the driver during the loading of the data driver, and
- the number of changes occurring at the output of the driver from one line to another.

It is also important to notice how these changes are appearing. Indeed if all outputs have the same value and are changing in one time, this is less energy consuming than if each output is different and is changing.

Then, based on all these assumptions, a critical test pattern called hereinafter chequered pattern can be defined per driver as illustrated by FIG. 3. This chequered pattern, which is a bit series always toggling between 0 and 1, introduces an overheating of the data driver and above all when the addressing speed is fast (clk and ENA are high) like for high-resolution displays. If the data driver is overheated a long time (many frames) it can be definitely damaged. Moreover, today, the data drivers are bonded on the PDP glass by using glue and it is almost impossible to remove them in order to perform an exchange. Therefore, if a data driver has been damaged, the whole panel can be thrown away.

Today, there are mainly three possibilities to avoid such a problem:

- limiting either the addressing speed, or the number of sub-fields used per frame;
- using a specific coding that should reduce the situation depicted in FIG. 3 for standard picture (reducing the toggling inside a codeword),
- detecting the critical patterns and reducing the number of sub-fields used during their addressing.

Solutions consisting in detecting chequered patterns in video pictures to be displayed also exist but the problem is not solved because chequered patterns can also be introduced by the dithering operation applied to any pictures. Indeed in case of cell-based dithering as defined in WO 01/71702 and EP 1 262 947, the structure of dithering with a level ½ is exactly the chequered pattern. Such a dithering is illustrated by the following example. In this example, the sub-fields have the following weights: 1-2-3-5-8-13-18-26-39-57-83. The following pixel values can be displayed:

0: 00000000000
( . . . )
46: 01011110000
56: 10111101000
( . . . )
255: 11111111111

The dithering consists in associating to each pixel value V of the picture to be displayed a dithering level L used to dither between two different pixel values $V_1$ and $V_2$ that can be coded by the given set of subfields such that $V=(1-L)\times V_1+L\times V_2$ with $V_1<V_2$ and $L\in[0, 1]$. The pixel values can be displayed by a group of adjacent cells (or luminous elements) of the panel or by a same cell on a plurality of frames. In the present case, to render the pixel value V=51, we will use spatial dithering of level ½ with the pixel values $V_1=46$ and $V_2=56$ So if a uniform gray level with value 51 is to be displayed on the whole panel, the following picture pixel values are displayed during one frame:

| | | | | | | | | | | | | | | | | | | | |
|---|---|---|---|---|---|---|---|---|---|---|---|---|---|---|---|---|---|---|---|
| 46 | 56 | 46 | 56 | 46 | 56 | 46 | 56 | 46 | 56 | 46 | 56 | 46 | 56 | 46 | 56 | 46 | 56 | 46 | 56 |
| 56 | 46 | 56 | 46 | 56 | 46 | 56 | 46 | 56 | 46 | 56 | 46 | 56 | 46 | 56 | 46 | 56 | 46 | 56 | 46 |
| 46 | 56 | 46 | 56 | 46 | 56 | 46 | 56 | 46 | 56 | 46 | 56 | 46 | 56 | 46 | 56 | 46 | 56 | 46 | 56 |
| 56 | 46 | 56 | 46 | 56 | 46 | 56 | 46 | 56 | 46 | 56 | 46 | 56 | 46 | 56 | 46 | 56 | 46 | 56 | 46 |
| 46 | 56 | 46 | 56 | 46 | 56 | 46 | 56 | 46 | 56 | 46 | 56 | 46 | 56 | 46 | 56 | 46 | 56 | 46 | 56 |
| 56 | 46 | 56 | 46 | 56 | 46 | 56 | 46 | 56 | 46 | 56 | 46 | 56 | 46 | 56 | 46 | 56 | 46 | 56 | 46 |

-continued

| | | | | | | | | | | | | | | | | | | | |
|---|---|---|---|---|---|---|---|---|---|---|---|---|---|---|---|---|---|---|---|
| 46 | 56 | 46 | 56 | 46 | 56 | 46 | 56 | 46 | 56 | 46 | 56 | 46 | 56 | 46 | 56 | 46 | 56 | 46 | 56 |
| 56 | 46 | 56 | 46 | 56 | 46 | 56 | 46 | 56 | 46 | 56 | 46 | 56 | 46 | 56 | 46 | 56 | 46 | 56 | 46 |
| 46 | 56 | 46 | 56 | 46 | 56 | 46 | 56 | 46 | 56 | 46 | 56 | 46 | 56 | 46 | 56 | 46 | 56 | 46 | 56 |
| 56 | 46 | 56 | 46 | 56 | 46 | 56 | 46 | 56 | 46 | 56 | 46 | 56 | 46 | 56 | 46 | 56 | 46 | 56 | 46 |

The subfield information sent to the data drivers are given by the following tables.

| $1^{st}$ sub-field | | | | | | | | | | | | | | | | | | | |
|---|---|---|---|---|---|---|---|---|---|---|---|---|---|---|---|---|---|---|---|
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |

| $2^{nd}$ sub-field | | | | | | | | | | | | | | | | | | | |
|---|---|---|---|---|---|---|---|---|---|---|---|---|---|---|---|---|---|---|---|
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |

| $3^{rd}$ sub-field | | | | | | | | | | | | | | | | | | | |
|---|---|---|---|---|---|---|---|---|---|---|---|---|---|---|---|---|---|---|---|
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |

| $4^{th}$, $5^{th}$ and $6^{th}$ sub-fields | | | | | | | | | | | | | | | | | | | |
|---|---|---|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 1 | 1 | 1 | 1 | 1 | 1 | 1 |

| $7^{th}$ sub-field | | | | | | | | | | | | | | | | | | | |
|---|---|---|---|---|---|---|---|---|---|---|---|---|---|---|---|---|---|---|---|
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |

| $8^{th}$ sub-field | | | | | | | | | | | | | | | | | | | |
|---|---|---|---|---|---|---|---|---|---|---|---|---|---|---|---|---|---|---|---|
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |
| 0 | 1 | 0 | 1 | 0 | 1 | 0 | 1 | 0 | 1 | 0 | 1 | 0 | 1 | 0 | 1 | 0 | 1 | 0 | 1 |
| 1 | 0 | 1 | 0 | 1 | 0 | 1 | 0 | 1 | 0 | 1 | 0 | 1 | 0 | 1 | 0 | 1 | 0 | 1 | 0 |

| $9^{th}$, $10^{th}$ and $11^{th}$ sub-fields | | | | | | | | | | | | | | | | | | | |
|---|---|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 | 0 | 0 | 0 | 0 |

As it can be seen in the previous tables, 5 sub-fields will use a chequered pattern. This means that even with a standard picture, the data driver overheat problem may occur because of dithering.

SUMMARY OF THE INVENTION

It is an object of the present invention to disclose a method and an apparatus reducing the number of chequered patterns in order to prevent the driver overheating.

According to the invention, this object is solved by selecting appropriate dithering levels for limiting the number of bit changes between the subfield code words of adjacent luminous elements.

More particularly, the invention concerns a method for processing video pictures data for display on a display device having a plurality of luminous elements corresponding to the pixels of a video picture, the luminous elements being organized in columns and lines, wherein the time of a video frame or field is divided into a plurality of sub-fields during which the luminous elements can be activated for light emission, a sub-field code word corresponding to said plurality of sub-fields being used for encoding the pixels values in which each bit can have either an "OFF" state or an "ON" state such that each luminous element is activated during a subfield when the corresponding bit of sub-field code word has an "ON" state. This method comprises:

a splitting step for splitting each pixel value of the picture to be displayed into at least first and second split pixel values, each split value being associated to a group of subfields of said plurality of subfields, a spatial dithering step for associating to each split pixel value V one dithering level L used to dither between two different pixel values $V_1$ and $V_2$ that can be coded by the associated group of subfields such that $V=(1-L)\times V_1+L\times V_2$ with $V_1<V_2$ and $L\in[0, 1]$, a coding step for coding the pixel values $V_1$ and $V_2$ into sub-field code words, each bit of the sub-field code word having a bit state.

According to the invention, the split pixel values and the dithering levels are selected such that, if the sum of the number of bits having a different state in the subfield code word of the pixel value V1 and the subfield code word of the pixel value V2 associated to the first split pixel value and the number of bits having a different state in the subfield code word of the pixel value V1 and the subfield code word of the pixel value V2 associated to the second split pixel value is greater than or equal to a first threshold, the sum of the absolute differences between the dithering level of each split pixel value and ½ is made greater than a second threshold. Thus, the split values and the dithering levels are selected to avoid that the dithering levels are close to ½ simultaneously, specially when the total number of different states in the sub-field code word (the sum of the number of bits having a different state in the subfield code word of the pixel value V1 and the subfield code word of the pixel value V2 associated to the first split pixel value and the number of bits having a different state in the subfield code word of the pixel value V1 and the subfield code word of the pixel value V2 associated to the second split pixel value) is high.

Preferably, the second threshold is greater than or equal to ¼. Under the value ¼, the benefits of the invention would not be significant. Preferably, the second threshold is equal to ½

In a preferred embodiment, the first threshold is equal to 0. Thus, for all the pixel values, the split pixel values and the dithering levels are selected such that the sum of the absolute differences between the dithering level of each split pixel value and ½ is greater than the second threshold. This aims at reducing in average the data driver current and not only the peak current.

In other embodiments, the first threshold can be chosen different from 0, for example for reducing only the peak current in the driver circuits.

The inventive method is particularly adapted to a specific coding called parallel Peak Coding (PPC) wherein

- each pixel value of the picture to be displayed is split into two first and second split pixel values, the first and second split values (a,b) being associated to first and second groups of subfields respectively,
- the number of subfields of the first group of subfields is substantially equal to the number of subfields of the second group of subfields, and
- the first and second pixel values are substantially equal.

With this coding, the dithering levels are selected as follows:

- the dithering level for the first split pixel value is ½ and the dithering level for the second split pixel value is 0, or
- the dithering level for the first split pixel value is 0 and the dithering level for the second split pixel value is ½, or
- the dithering level for the first and second split pixel values are different from ½.

The invention concerns also a device for processing video pictures data for display on a display device having a plurality of luminous elements corresponding to the pixels of a video picture, the luminous elements being organized in columns and lines, wherein the time of a video frame or field is divided into a plurality of sub-fields during which the luminous elements can be activated for light emission, a sub-field code word corresponding to said plurality of sub-fields being used for encoding the pixels values in which each bit can have either an "OFF" state or an "ON" state such that each luminous element is activated during a subfield when the corresponding bit of sub-field code word has an "ON" state The device comprises

- splitting means for splitting each pixel value of the picture to be displayed into at least first and second split pixel values, each split value being associated to a group of subfields of said plurality of subfields,
- spatial dithering means for associating to each split pixel value V one dithering level L used to dither between two different pixel values $V_1$ and $V_2$ that can be coded by the associated group of subfields such that $V=(1-L)\times V_1+L\times V_2$ with $V_1<V_2$ and $L\in[0, 1]$, and
- coding means for coding the pixel values $V_1$ and $V_2$ into sub-field code words, each bit of the sub-field code word having a bit state.

In this device, the splitting means and the spatial dithering means are controlled such that, if the sum of the number of bits having a different state in the subfield code word of the pixel value V1 and the subfield code word of the pixel value V2 associated to the first split pixel value and the number of bits having a different state in the subfield code word of the pixel value V1 and the subfield code word of the pixel value V2 associated to the second split pixel value is greater than or equal to a first threshold, the sum of the absolute differences between the dithering level of each split pixel value and ½ is made greater than a second threshold.

BRIEF DESCRIPTION OF THE DRAWINGS

Exemplary embodiments of the invention are illustrated in the drawings and are explained in more detail in the following description. In the drawings.

DESCRIPTION OF PREFERRED EMBODIMENTS

The inventive method proposes to reduce the number of chequered patterns by splitting each pixel value into a plurality of split pixel values and by selecting appropriate pixel values and appropriate dithering levels for these pixel values.

Figure 1:
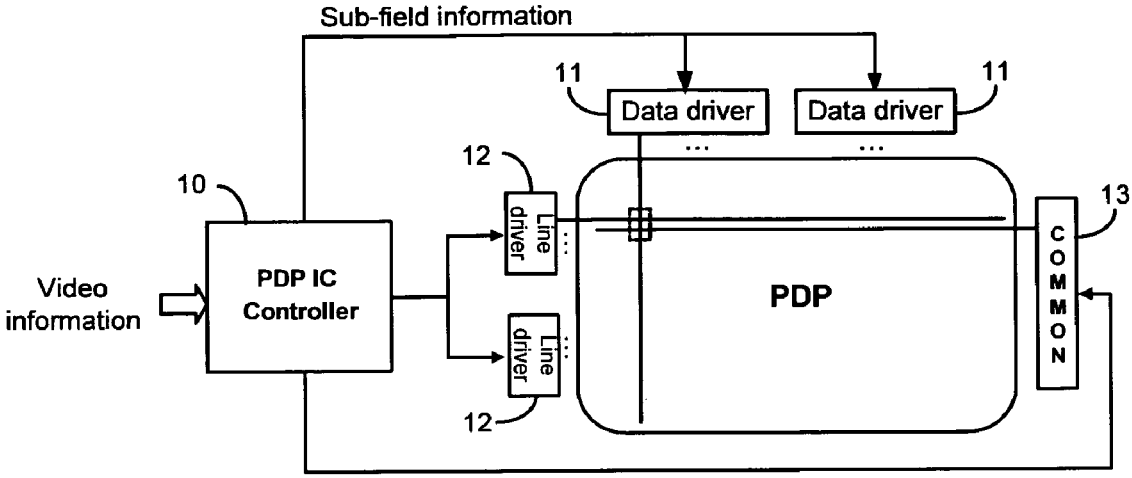
FIG. 1 shows the overall electronic structure of a plasma display panel.
Figure 2:
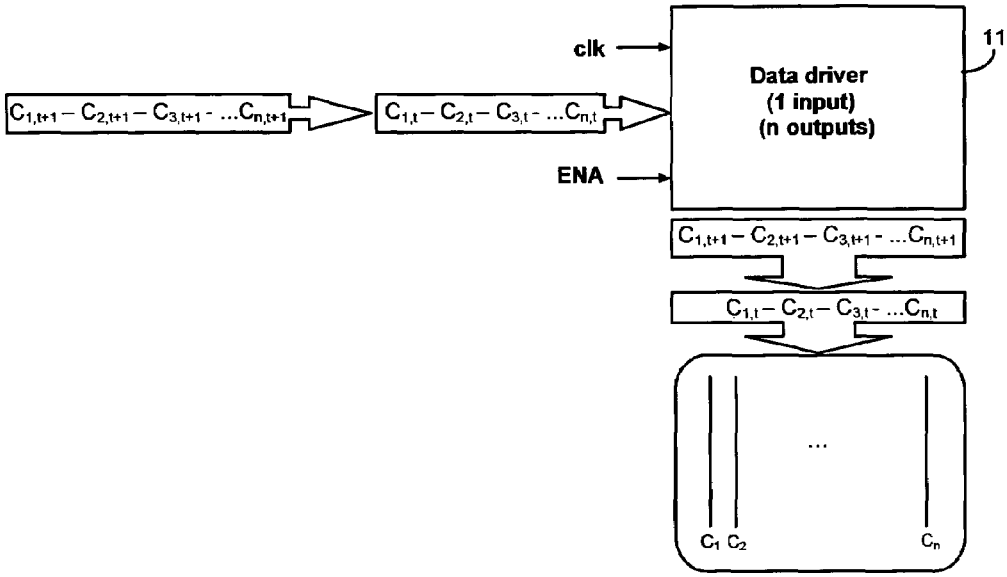
FIG. 2 shows the global functioning of the data driver of the plasma display panel of FIG. 1.
Figure 3:
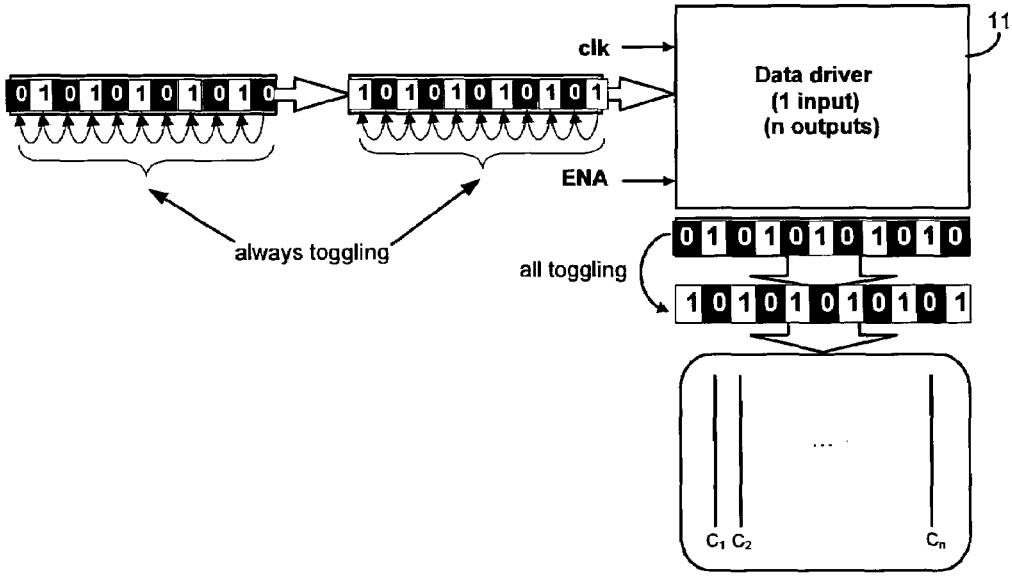
FIG. 3 shows the critical data pattern introducing an overheating of the data driver.
Figure 4:
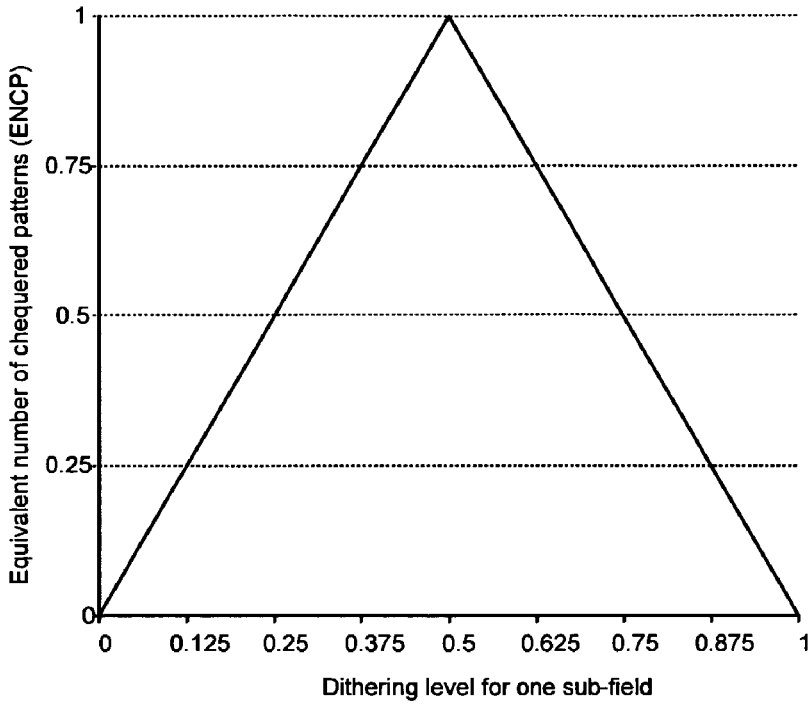
FIG. 4 shows the equivalent number of chequered patterns for every dithering level.

It is possible to define for every dithering level the equivalent number of chequered pattern (ENCP). A dithering level of ½ on one sub-field corresponds to one chequered pattern (ENCP=1) i.e. when looking at 5 adjacent cells (01010 or 10101) there are 4 transitions (0 to 1 or 1 to 0). For a dithering level of ¼ or ¾, when looking at 5 adjacent cells (00010 or 11101), there are only 2 transitions, so this will be equivalent to a half chequered pattern (ENCP=0.5). The dithering levels of ⅛, ⅜, ⅝ and ⅞ correspond to a fourth of a chequered pattern (ENCP=0.25). FIG. 4 shows the equivalent number of chequered patterns for every dithering level.

As mentioned previously, it is proposed to reduce this number of chequered patterns on at least one subfield of the subfields set. The subfields set is divided into two groups of subfields and the number of chequered patterns is reduced at least in one of the two groups.

The invention will be described with reference to a specific coding called parallel Peak Coding (PPC) using two groups of subfields having substantially the same number of subfields and for which the driver circuit overheating is a big problem. So, the principle of this coding will be first described and the inventive method will follow.

The general idea of the Parallel Peak Coding is to have almost always the same energy in two packets of light and to encode the code words for these two packets differently so that changes in sub-field code word will not appear in the two packet code words simultaneously. This coding is notably used for reducing the false contour effect with any number of sub-fields. It will be illustrated by a Parallel Peak Coding with 15 sub-fields. Considering a frame comprising 15 sub-fields with the following weights:

1-2-3-5-7-9-11-14-17-20-24-28-33-38-43

In the parallel peak coding, these sub-fields are organized in two consecutive groups. A part of a sub-field code word is assigned to each group. These two groups of sub-fields are used for generating the two packets of light. The pixel value to be displayed is thus split into two split pixel values: one split pixel value is displayed by the first group of subfields and the other split is displayed by the second group of subfields.

For example, the odd sub-fields are grouped in a first group, called G1, and the even sub-fields are grouped in a second group called G2.

G1: 1-3-7-11-17-24-33-43

G2: 2-5-9-14-20-28-38

Of course, the distribution of the sub-fields between the two groups can be carried out differently. The only condition is that the two groups should comprise sub-fields of different weights. Furthermore, the sub-fields of the group G1 could be put before or after the sub-fields of the group G2.

Furthermore, a different coding is selected for each group of sub-fields. For example, the following encoding tables can be used:

for the group G1 (1-3-7-11-17-24-33-43)

| Pixel value | Code word | Code number |
|---|---|---|
| value 0: | 00000000 | Code 0 |
| value 1: | 10000000 | Code 1 |
| value 3: | 01000000 | Code 2 |
| value 4: | 11000000 | Code 3 |
| value 7: | 00100000 | Code 4 |
| value 8: | 10100000 | Code 5 |
| Value 10: | 01100000 | Code 6 |
| Value 11: | 11100000 | Code 7 |
| Value 14: | 01010000 | Code 8 |
| Value 15: | 11010000 | Code 9 |
| Value 18: | 00110000 | Code 10 |
| Value 19: | 10110000 | Code 11 |
| Value 21: | 01110000 | Code 12 |
| Value 22: | 11110000 | Code 13 |
| Value 24: | 00101000 | Code 14 |
| Value 25: | 10101000 | Code 15 |
| Value 27: | 01101000 | Code 16 |
| Value 28: | 11101000 | Code 17 |
| Value 29: | 10011000 | Code 18 |
| Value 31: | 01011000 | Code 19 |
| Value 32: | 11011000 | Code 20 |
| Value 35: | 00111000 | Code 21 |
| Value 36: | 10111000 | Code 22 |
| Value 38: | 01111000 | Code 23 |
| Value 39: | 11111000 | Code 24 |
| Value 42: | 00110100 | Code 25 |
| Value 43: | 10110100 | Code 26 |
| Value 45: | 01110100 | Code 27 |
| Value 46: | 11110100 | Code 28 |
| Value 48: | 00101100 | Code 29 |
| Value 49: | 10101100 | Code 30 |
| Value 51: | 01101100 | Code 31 |
| Value 52: | 11101100 | Code 32 |
| Value 53: | 10011100 | Code 33 |

-continued

| Pixel value | Code word | Code number |
|---|---|---|
| Value 55: | 01011100 | Code 34 |
| Value 56: | 11011100 | Code 35 |
| Value 59: | 00111100 | Code 36 |
| Value 60: | 10111100 | Code 37 |
| Value 62: | 01111100 | Code 38 |
| Value 63: | 11111100 | Code 39 |
| Value 65: | 11011010 | Code 40 |
| Value 68: | 00111010 | Code 41 |
| value 69: | 10111010 | Code 42 |
| value 71: | 01111010 | Code 43 |
| value 72: | 11111010 | Code 44 |
| value 75: | 00110110 | Code 45 |
| value 76: | 10110110 | Code 46 |
| value 78: | 01110110 | Code 47 |
| value 79: | 11110110 | Code 48 |
| value 81: | 00101110 | Code 49 |
| value 82: | 10101110 | Code 50 |
| value 84: | 01101110 | Code 51 |
| value 85: | 11101110 | Code 52 |
| value 86: | 10011110 | Code 53 |
| value 88: | 01011110 | Code 54 |
| value 89: | 11011110 | Code 55 |
| value 92: | 00111110 | Code 56 |
| value 93: | 10111110 | Code 57 |
| value 95: | 01111110 | Code 58 |
| value 96: | 11111110 | Code 59 |
| value 98: | 01011101 | Code 60 |
| value 99: | 11011101 | Code 61 |
| value 102: | 00111101 | Code 62 |
| value 103: | 10111101 | Code 63 |
| value 105: | 01111101 | Code 64 |
| value 106: | 11111101 | Code 65 |
| value 107: | 01011011 | Code 66 |
| value 108: | 11011011 | Code 67 |
| value 111: | 00111011 | Code 68 |
| value 112: | 10111011 | Code 69 |
| value 114: | 01111011 | Code 70 |
| value 115: | 11111011 | Code 71 |
| value 118: | 00110111 | Code 72 |
| value 119: | 10110111 | Code 73 |
| value 121: | 01110111 | Code 74 |
| value 122: | 11110111 | Code 75 |
| value 124: | 00101111 | Code 76 |
| value 125: | 10101111 | Code 77 |
| value 127: | 01101111 | Code 78 |
| value 128: | 11101111 | Code 79 |
| value 129: | 10011111 | Code 80 |
| value 131: | 01011111 | Code 81 |
| value 132: | 11011111 | Code 82 |
| value 135: | 00111111 | Code 83 |
| value 136: | 10111111 | Code 84 |
| value 138: | 01111111 | Code 85 |
| value 139: | 11111111 | Code 86 |

for the group G2 (2-5-9-14-20-28-38)

| Pixel value | Code word | Code number |
|---|---|---|
| value 0: | 0000000 | Code 0 |
| value 2: | 1000000 | Code 1 |
| value 5: | 0100000 | Code 2 |
| value 7: | 1100000 | Code 3 |
| value 9: | 0010000 | Code 4 |
| value 11: | 1010000 | Code 5 |
| value 14: | 0110000 | Code 6 |
| value 16: | 1110000 | Code 7 |
| value 19: | 0101000 | Code 8 |
| value 21: | 1101000 | Code 9 |
| value 23: | 0011000 | Code 10 |
| value 25: | 1011000 | Code 11 |
| value 28: | 0111000 | Code 12 |
| value 30: | 1111000 | Code 13 |
| value 34: | 0110100 | Code 14 |

-continued

| Pixel value | Code word | Code number |
|---|---|---|
| value 36: | 1110100 | Code 15 |
| value 39: | 0101100 | Code 16 |
| value 41: | 1101100 | Code 17 |
| value 43: | 0011100 | Code 18 |
| value 45: | 1011100 | Code 19 |
| value 48: | 0111100 | Code 20 |
| value 50: | 1111100 | Code 21 |
| value 53: | 1011010 | Code 22 |
| value 56: | 0111010 | Code 23 |
| value 58: | 1111010 | Code 24 |
| value 59: | 1010110 | Code 25 |
| value 62: | 0110110 | Code 26 |
| value 64: | 1110110 | Code 27 |
| value 67: | 0101110 | Code 28 |
| value 69: | 1101110 | Code 29 |
| value 71: | 0011110 | Code 30 |
| value 73: | 1011110 | Code 31 |
| value 76: | 0111110 | Code 32 |
| value 78: | 1111110 | Code 33 |
| value 81: | 0011101 | Code 34 |
| value 83: | 1011101 | Code 35 |
| value 86: | 0111101 | Code 36 |
| value 88: | 1111101 | Code 37 |
| value 89: | 0011011 | Code 38 |
| value 91: | 1011011 | Code 39 |
| value 94: | 0111011 | Code 40 |
| value 96: | 1111011 | Code 41 |
| value 97: | 1010111 | Code 42 |
| value 100: | 0110111 | Code 43 |
| value 102: | 1110111 | Code 44 |
| value 105: | 0101111 | Code 45 |
| value 107: | 1101111 | Code 46 |
| value 109: | 0011111 | Code 47 |
| value 111: | 1011111 | Code 48 |
| value 114: | 0111111 | Code 49 |
| value 116: | 1111111 | Code 50 |

All the pixel values can not be achieved. So, the missing pixel values are expressed from the available values by a dithering step. Two independent dithering blocks can be used for the two codes of these two packets of light.

A way to determine the two split pixel values to be displayed by the two packets of light is given below. If i designates an input pixel value, a the split pixel value assigned to the first group of subfields G1, and b the split pixel value assigned to the second group of subfields G2, the values a and b can be computed as follows:

For $0 \leqq i \leqq 1$, $a=i$ and $b=0$.

For $1 \leqq i \leqq 2$, $a=1$ and $b=i-1$.

For $2 \leqq i \leqq 232$, $a=i/2$ and $b=i/2$. ($232=2\times116$)

For $232 \leqq i \leqq 255$, $a=i-116$ and $b=116$.

In PPC, the same light energy is emitted during these two packets of light. In this example, for all levels between 2 and 232, half of this value is expressed by the first peak and the second half by the second peak. So for the input pixel value 140, the two peaks have to express the level 70. They both need dithering to render it because this level is not available with these groups of sub-fields. The first peak will use a dithering level ½ using the pixel values 69 (10111010) and 71 (01111010). The second peak will use a dithering level ½ using the pixel values 69 (1101110) and 71 (0011110). In case of a uniform gray level of 70 in input, the code of the first split pixel value will display a chequered pattern on 2 sub-fields, while the code of the second split pixel value on 3 sub-fields, so in total 5 sub-fields will use a chequered pattern. This means that the data driver could overheat.

Since the two peaks are working in parallel, the number of sub-field bit changes between two pixel values can be twice as big as when working with only one peak (classical code). For the input levels below 2 and above 232, since the two peaks are not working in parallel, the number of sub-field bit changes will be minimal.

Figure 5:
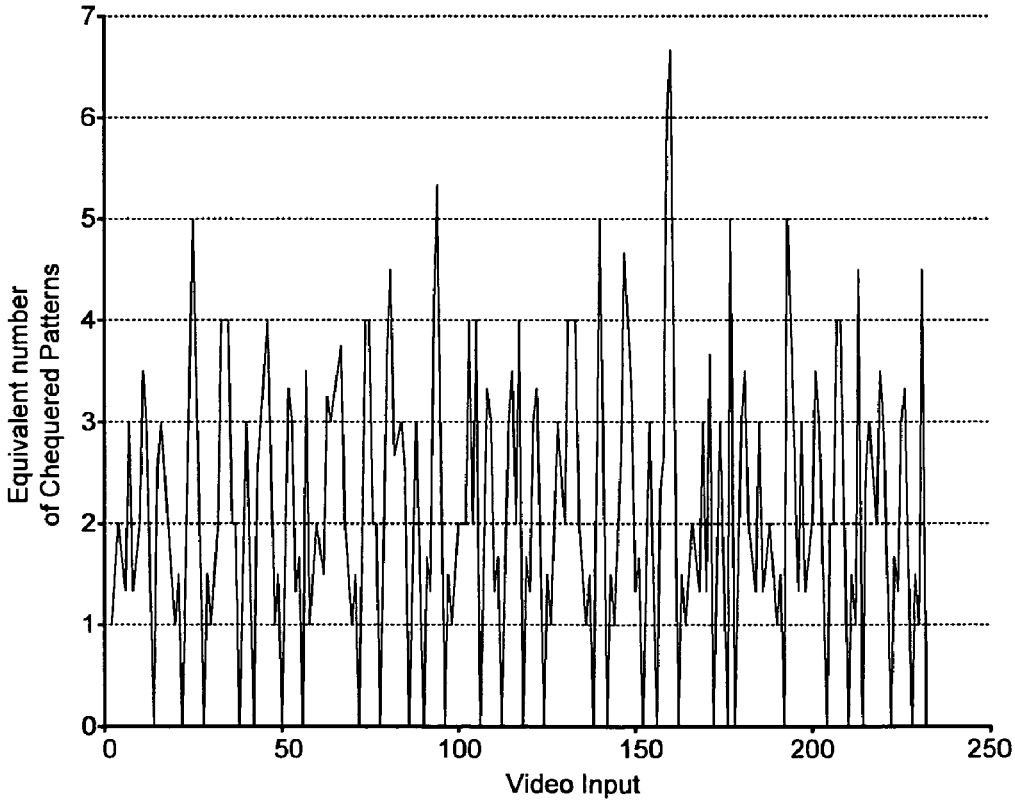
FIG. 5 shows the equivalent number of chequered patterns for every pixel value between 2 and 232.

FIG. 5 shows the equivalent number of chequered pattern for every pixel value between 2 and 232 for the Parallel Peak Coding as defined previously. The equivalent number of chequered patterns for a pixel value is the sum of the ENCPs defined for all its subfields. As it can be seen the equivalent number of chequered patterns for different pixel values displayed by using the Parallel Peak Coding can be quite high (higher than 3 or 4) for some pixel values.

In one peak, there are maximum 4 sub-field bit changes between the two pixel values used for the dithering. But since the two peaks are working in parallel, these sub-field bit changes add up. When the dithering level is close to ½ on the two peaks, the number of bit changes is maximum for the considered pixel value and can reach 6 or 7.

The inventive method consists in selecting appropriate split pixel values and dithering levels to reduce the equivalent number of chequered patterns. The invention is described for a dithering step consisting in associating to each split pixel value V one dithering level L used to dither between two different pixel values $V_1$ and $V_2$ that can be coded by the given group of subfields such that $V=(1-L)\times V_1+L\times V_2$ with $V_1<V_2$ and $L\epsilon[0, 1]$. According to the invention, the split pixel values and dithering levels are selected such that, if the sum of the number of bits having a different state in the subfield code word of the pixel value V1 and the subfield code word of the pixel value V2 associated to the first split pixel value and the number of bits having a different state in the subfield code word of the pixel value V1 and the subfield code word of the pixel value V2 associated to the second split pixel value is greater than or equal to a first threshold, the sum of the absolute differences between the dithering level of each split pixel value and ½ is greater than a second threshold.

Thus, the split pixel values and the dithering levels are selected such that the two or more split pixel values do not have simultaneously a dithering level close to ½ where the ENCP is maximal (see FIG. 4).

The second threshold is advantageously equal to or greater than ¼ and is preferably equal to ½.

The first threshold is preferably equal to 0. Thus, the dithering level is optimized whatever the number of bit changes in the two split pixel values.

In a variant, the first threshold can be increased to a value greater than 0. For example, it can be equal to 4. So, the optimized selection of the split pixel values and the dithering levels will be done only if the number of bit changes in the two split pixel values is 4 or more.

In the following description, the first threshold is preferably equal to 0.

In a specific embodiment, it consists in splitting the set of subfields into at least two groups of subfields and using dithering levels other than ½ for the split pixel values associated to these groups of subfields or using a dithering level of ½ for only one split pixel value and a dithering level of 0 (no dithering) for the other split pixel value.

For this Parallel Peak Coding (PPC), it consists in using a dithering level of ½ on only one of the two split pixel values or by using a dithering level other than ½ on the two split pixel values. The goal of the inventive method is to maximize the sum of the absolute differences between the dithering level of each split value and ½ (dithering level where the ENCP is maximal).

The inventive method solution will be now described in detail for Parallel Peak Coding (PPC), i.e. two substantially identical split pixel values (a and b) and two groups of sub-fields (G1 and G2) having substantially the same number of subfields.

As mentioned before, the inventive method for PPC consists in using a dithering level of ½ on only one of the two split pixel values or by using a dithering level other than ½ on the two split pixel values. For example basic pixel values using a dithering level of 0 for at least one of the two split pixel values are first defined. When one split pixel value uses a dithering level ½, the other one is forced to use a dithering level 0 (no dithering). Thus the two split pixel values are not necessarily exactly identical but they are very close. For these basic pixel values, the maximum ENCP is then equal to the number of sub-field bit changes for the split pixel value having a dithering level different from 0.

More precisely, each basic pixel value is the combination of a split pixel value a displayed during the first peak and a split pixel value b displayed during the second peak. Each split pixel value is either a pixel value without dithering or a pixel value using a dithering level ½. It can not be the combination of two split pixel values using dithering levels ½. From one new pixel value to the next new pixel value, the first split pixel value (respectively the second split pixel value) can either be unchanged if the dithering level is equal to 0 or go from a code using no dithering to a code using a dithering level ½ or inversely.

Below is given an example of the new Parallel peak Code, called hereinafter matched PPC, made for the 15 Sub-fields presented previously. If we consider two successive code numbers n and n+1 in the encoding table defined previously for the group G1 or for the group G2, the code n½ means that a dithering level of ½ is assigned to the code n and that the pixel value of the code n½ is equal to the sum of half of the value of the code n and half of the value of the code n+1.

| 1st peak | | 2nd peak | | basic |
|---|---|---|---|---|
| code | Pixel value a | code | Pixel value b | pixel value |
| 0 | 0 | 0 | 0 | 0 |
| 0½ | 0.5 | 0 | 0 | 0.5 |
| 1 | 1 | 0½ | 1 | 2 |
| 1½ | 2 | 1 | 2 | 4 |
| 2 | 3 | 1½ | 3.5 | 6.5 |
| 2½ | 3.5 | 2 | 5 | 8.5 |
| 3 | 4 | 2 | 5 | 9 |
| 3½ | 5.5 | 2 | 5 | 10.5 |
| 4 | 7 | 2½ | 6 | 13 |
| 4½ | 7.5 | 3 | 7 | 14.5 |
| 5 | 8 | 3½ | 8 | 16 |
| 5½ | 9 | 4 | 9 | 18 |
| 6 | 10 | 4½ | 10 | 20 |
| 6½ | 10.5 | 5 | 11 | 21.5 |
| 7 | 11 | 5½ | 12.5 | 23.5 |
| 7½ | 12.5 | 6 | 14 | 26.5 |
| 8 | 14 | 6 | 14 | 28 |
| 8½ | 14.5 | 6 | 14 | 28.5 |
| 9 | 15 | 6½ | 15 | 30 |
| 9½ | 16.5 | 7 | 16 | 32.5 |
| 10 | 18 | 7½ | 17.5 | 35.5 |
| 10½ | 18.5 | 8 | 19 | 37.5 |
| 11 | 19 | 8 | 19 | 38 |
| 11½ | 20 | 8 | 19 | 39 |
| 12 | 21 | 8½ | 20 | 41 |
| 12½ | 21.5 | 9 | 21 | 42.5 |
| 13 | 22 | 9½ | 22 | 44 |
| 13½ | 23 | 10 | 23 | 46 |
| 14 | 24 | 10½ | 24 | 48 |
| 14½ | 24.5 | 11 | 25 | 49.5 |
| 15 | 25 | 11 | 25 | 50 |

-continued

| 1st peak | | 2nd peak | | basic |
|---|---|---|---|---|
| code | Pixel value a | code | Pixel value b | pixel value |
| 15½ | 26 | 11 | 25 | 51 |
| 16 | 27 | 11½ | 26.5 | 53.5 |
| 16½ | 27.5 | 12 | 28 | 55.5 |
| 17 | 28 | 12 | 28 | 56 |
| 17½ | 28.5 | 12 | 28 | 56.5 |
| 18 | 29 | 12½ | 29 | 58 |
| 18½ | 30 | 13 | 30 | 60 |
| 19 | 31 | 13 | 30 | 61 |
| 19½ | 31.5 | 13 | 30 | 61.5 |
| 20 | 32 | 13½ | 32 | 64 |
| 20½ | 33.5 | 14 | 34 | 67.5 |
| 21 | 35 | 14½ | 35 | 70 |
| 21½ | 35.5 | 15 | 36 | 71.5 |
| 22 | 36 | 15 | 36 | 72 |
| 22½ | 37 | 15 | 36 | 73 |
| 23 | 38 | 15½ | 37.5 | 75.5 |
| 23½ | 38.5 | 16 | 39 | 77.5 |
| 24 | 39 | 16½ | 40 | 79 |
| 24½ | 40.5 | 17 | 41 | 81.5 |
| 25 | 42 | 17½ | 42 | 84 |
| 25½ | 42.5 | 18 | 43 | 85.5 |
| 26 | 43 | 18 | 43 | 86 |
| 26½ | 44 | 18 | 43 | 87 |
| 27 | 45 | 18½ | 44 | 89 |
| 27½ | 45.5 | 19 | 45 | 90.5 |
| 28 | 46 | 19½ | 46.5 | 92.5 |
| 28½ | 47 | 20 | 48 | 95 |
| 29 | 48 | 20 | 48 | 96 |
| 29½ | 48.5 | 20 | 48 | 96.5 |
| 30 | 49 | 20½ | 49 | 98 |
| 30½ | 50 | 21 | 50 | 100 |
| 31 | 51 | 21½ | 51.5 | 102.5 |
| 31½ | 51.5 | 22 | 53 | 104.5 |
| 32 | 52 | 22 | 53 | 105 |
| 32½ | 52.5 | 22 | 53 | 105.5 |
| 33 | 53 | 22 | 53 | 106 |
| 33½ | 54 | 22 | 53 | 107 |
| 34 | 55 | 22½ | 54.5 | 109.5 |
| 34½ | 55.5 | 23 | 56 | 111.5 |
| 35 | 56 | 23½ | 57 | 113 |
| 35½ | 57.5 | 24 | 58 | 115.5 |
| 36 | 59 | 24½ | 58.5 | 117.5 |
| 36½ | 59.5 | 25 | 59 | 118.5 |
| 37 | 60 | 25½ | 60.5 | 120.5 |
| 37½ | 61 | 26 | 62 | 123 |
| 38 | 62 | 26 | 62 | 124 |
| 38½ | 62.5 | 26 | 62 | 124.5 |
| 39 | 63 | 26½ | 63 | 126 |
| 39½ | 64 | 27 | 64 | 128 |
| 40 | 65 | 27½ | 65.5 | 130.5 |
| 40½ | 66.5 | 28 | 67 | 133.5 |
| 41 | 68 | 28½ | 68 | 136 |
| 41½ | 68.5 | 29 | 69 | 137.5 |
| 42 | 69 | 29½ | 70 | 139 |
| 42½ | 79 | 30 | 71 | 141 |
| 43 | 71 | 30 | 71 | 142 |
| 43½ | 71.5 | 30 | 71 | 142.5 |
| 44 | 72 | 30½ | 72 | 144 |
| 44½ | 73.5 | 31 | 73 | 146.5 |
| 45 | 75 | 31½ | 74.5 | 149.5 |
| 45½ | 75.5 | 32 | 76 | 151.5 |
| 46 | 76 | 32½ | 77 | 153 |
| 46½ | 77 | 33 | 78 | 155 |
| 47 | 78 | 33 | 78 | 156 |
| 47½ | 78.5 | 33 | 78 | 156.5 |
| 48 | 79 | 33½ | 79.5 | 158.5 |
| 48½ | 80 | 34 | 81 | 161 |
| 49 | 81 | 34 | 81 | 162 |
| 49½ | 81.5 | 34 | 81 | 162.5 |
| 50 | 82 | 34½ | 82 | 164 |
| 50½ | 83 | 35 | 83 | 166 |
| 51 | 84 | 35½ | 84.5 | 168.5 |
| 51½ | 84.5 | 36 | 86 | 170.5 |
| 52 | 85 | 36 | 86 | 171 |

-continued

| 1st peak | | 2nd peak | | basic |
|---|---|---|---|---|
| code | Pixel value a | code | Pixel value b | pixel value |
| 52½ | 85.5 | 36 | 86 | 171.5 |
| 53 | 86 | 36½ | 87 | 173 |
| 53½ | 87 | 37 | 88 | 175 |
| 54 | 88 | 37 | 88 | 176 |
| 54 | 88 | 37½ | 88.5 | 176.5 |
| 54½ | 88.5 | 38 | 89 | 177.5 |
| 55 | 89 | 38½ | 90 | 179 |
| 55½ | 90.5 | 39 | 91 | 181.5 |
| 56 | 92 | 39 | 91 | 183 |
| 56½ | 92.5 | 39 | 91 | 183.5 |
| 57 | 93 | 39½ | 92.5 | 185.5 |
| 57½ | 94 | 40 | 94 | 188 |
| 58 | 95 | 40½ | 95 | 190 |
| 58½ | 95.5 | 41 | 96 | 191.5 |
| 59 | 96 | 41½ | 96.5 | 192.5 |
| 59½ | 97 | 42 | 97 | 194 |
| 60 | 98 | 42½ | 98.5 | 196.5 |
| 60½ | 98.5 | 43 | 100 | 198.5 |
| 61 | 99 | 43 | 100 | 199 |
| 61½ | 100.5 | 43 | 100 | 200.5 |
| 62 | 102 | 43½ | 101 | 203 |
| 62½ | 102.5 | 44 | 102 | 204.5 |
| 63 | 103 | 44½ | 103.5 | 206.5 |
| 63½ | 104 | 45 | 105 | 209 |
| 64 | 105 | 45 | 105 | 210 |
| 64½ | 105.5 | 45 | 105 | 210.5 |
| 65 | 106 | 45½ | 106 | 212 |
| 65½ | 106.5 | 46 | 107 | 213.5 |
| 66 | 107 | 46 | 107 | 214 |
| 66½ | 107.5 | 46 | 107 | 214.5 |
| 67 | 108 | 46½ | 108 | 216 |
| 67½ | 109.5 | 47 | 109 | 218.5 |
| 68 | 111 | 47½ | 110 | 221 |
| 68½ | 111.5 | 48 | 111 | 222.5 |
| 69 | 112 | 48½ | 112.5 | 224.5 |
| 69½ | 113 | 49 | 114 | 227 |
| 70 | 114 | 49 | 114 | 228 |
| 70½ | 114.5 | 49 | 114 | 228.5 |
| 71 | 115 | 49½ | 115 | 230 |
| 71½ | 116.5 | 50 | 116 | 232.5 |
| 72 | 118 | 50 | 116 | 234 |
| 72½ | 118.5 | 50 | 116 | 234.5 |
| 73 | 119 | 50 | 116 | 235 |
| 73½ | 120 | 50 | 116 | 236 |
| 74 | 121 | 50 | 116 | 237 |
| 74½ | 121.5 | 50 | 116 | 237.5 |
| 75 | 122 | 50 | 116 | 238 |
| 75½ | 123 | 50 | 116 | 239 |
| 76 | 124 | 50 | 116 | 240 |
| 76½ | 124.5 | 50 | 116 | 240.5 |
| 77 | 125 | 50 | 116 | 241 |
| 77½ | 126 | 50 | 116 | 242 |
| 78 | 127 | 50 | 116 | 243 |
| 78½ | 127.5 | 50 | 116 | 243.5 |
| 79 | 128 | 50 | 116 | 244 |
| 79½ | 128.5 | 50 | 116 | 244.5 |
| 80 | 129 | 50 | 116 | 245 |
| 80½ | 130 | 50 | 116 | 246 |
| 81 | 131 | 50 | 116 | 247 |
| 81½ | 131.5 | 50 | 116 | 247.5 |
| 82 | 132 | 50 | 116 | 248 |
| 82½ | 133.5 | 50 | 116 | 249.5 |
| 83 | 135 | 50 | 116 | 251 |
| 83½ | 135.5 | 50 | 116 | 251.5 |
| 84 | 136 | 50 | 116 | 252 |
| 84½ | 137 | 50 | 116 | 253 |
| 85 | 138 | 50 | 116 | 254 |
| 85½ | 138.5 | 50 | 116 | 254.5 |
| 86 | 139 | 50 | 116 | 255 |

The missing pixel values (pixel values between two basic pixel values) are generated by interpolation of these basic pixel values.

It is interesting to see what happens in the two peaks when interpolating the missing pixel values. Each interpolated pixel value is located between two consecutive basic pixel values (a first one and a second one). Depending on the nature of these two basic pixel values (using a ½ dithering or no dithering for the first split pixel value and/or for the second split pixel value), two different cases can be defined (all the others being symmetrical):

a) the first basic pixel value has one split pixel value using no dithering (code n) and the other one using also no dithering (code p), and the second basic pixel value has one split pixel value using a dithering level ½ (code n½) and the other one using no dithering (code p). In this case, all the interpolated pixel values between the pixel values corresponding to the codes (n+p) and (n½+p) will use a dithering only on one split pixel value, the dithering level of this split pixel value being included between 0 and 1.

As an example in the previous table, the interpolated pixel value 200 is generated by the code 61 with a dithering level equal to ⅓(=⅔×½) for the first split pixel value and the code 43 with no dithering for the second split pixel value. The ENCP is then about 0.66×3 (3 subfield bit changes) for the first split pixel value and 0 for the second split pixel value according to FIG. 4. The global ENCP is thus about 2.

b) The first basic pixel value has one split pixel value having a dithering level equal to ½ (code n½) and the other one using no dithering (code p), and the second basic pixel value has one split pixel value using no dithering (code (n+1)) and the other one using a dithering level ½ (code p½). In this case, all the interpolated pixel values between the pixel values corresponding to the codes (n½+p) and ((n+1)+p½) will use dithering on the two split pixel values. But the two dithering levels will be, in a certain sense, complementary (the difference of the two dithering levels will always be equal to ½). For example, one pixel value will use a dithering level ¾ for one split pixel value and ¼ on the other. If the number of sub-field bit changes between code n and code (n+1) is the same than between the code p and (p+1), then all pixel values between the pixel values corresponding to the codes (n½+p) and ((n+1)+p½) will have the same ENCP. In other words, the ENCP between the two new pixel values between the pixel values corresponding to the codes (n½+p) and ((n+1)+p½) will go from the ENCP of one split pixel value to the ENCP of the other split pixel value. It means that the ENCP will smaller than or equal to the biggest ENCP of the two split pixel values).

As an example, the interpolated video value 140 is generated by the code 42 with a dithering level ¼ for the first split pixel value and the code 29 with a dithering level ¾ for the second split pixel value. The ENCP is about 0.5×2 (2 subfield bit changes) for the first split pixel value and 0.5×3 (3 subfield bit changes) for the second split pixel value according to FIG. 4. The global ENCP is about 2.5 (instead of 5=1×2+1×3 if a code 42½ is used for the first split pixel value and a code 29½ for the second split pixel value).

This matched PPC remains compatible with the standard PPC implementation since the two split pixel values have substantially the same energy. Only modified look-up tables are needed.

Figure 6:
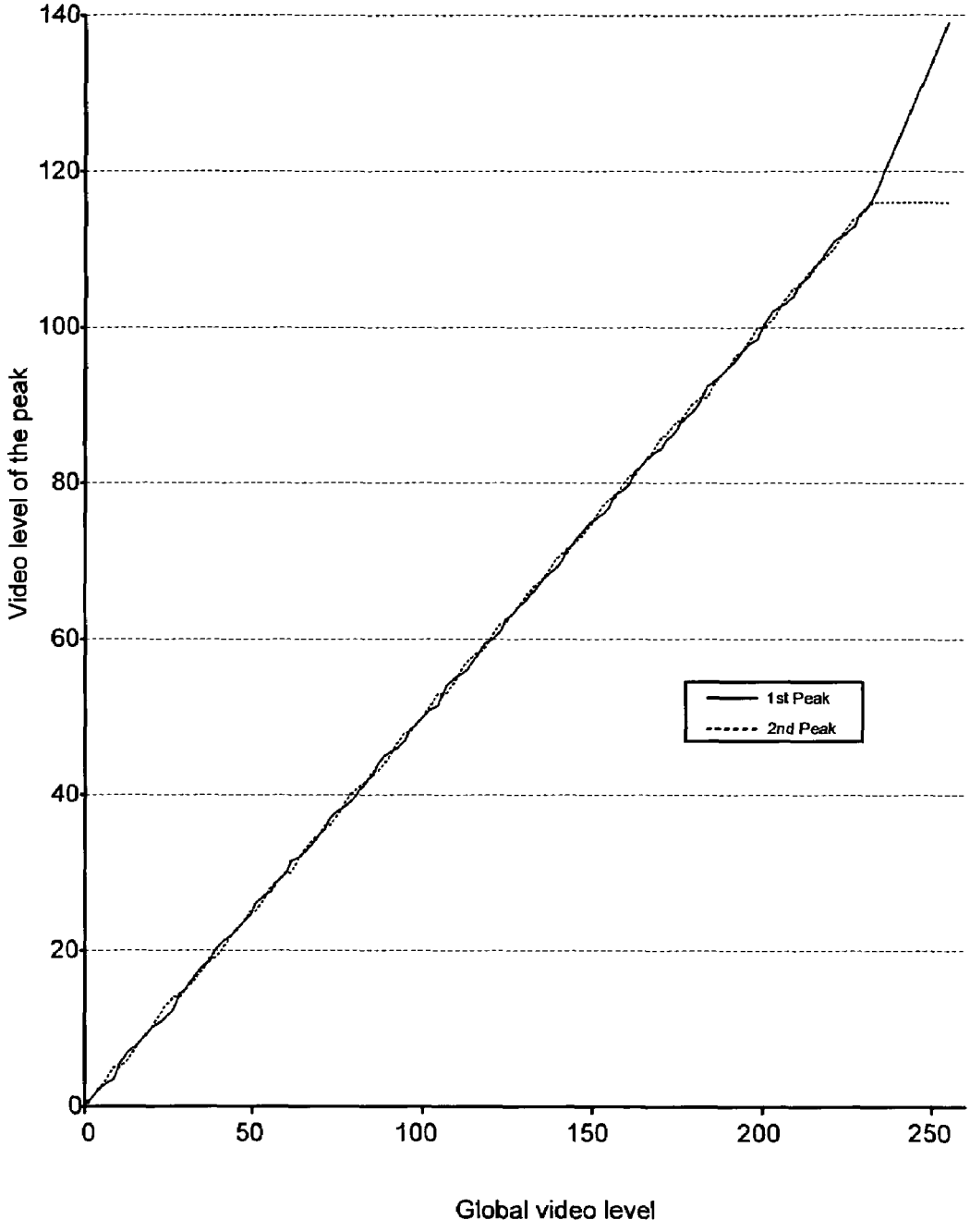
FIG. 6 shows the partition between the first peak and the second peak for all the pixel values between 0 and 255.

For all video inputs, the partition between the first and the second split pixel values is shown at FIG. 6. In case of standard PPC, the two curves would be identical for all input values between 2 and 232. Here, they are slightly different. But because their differences are very small, the picture quality is substantially the same than with standard PPC. In fact, the picture quality is slightly better because the dithering levels on the two split pixel values are mostly complementary.

Figure 7:
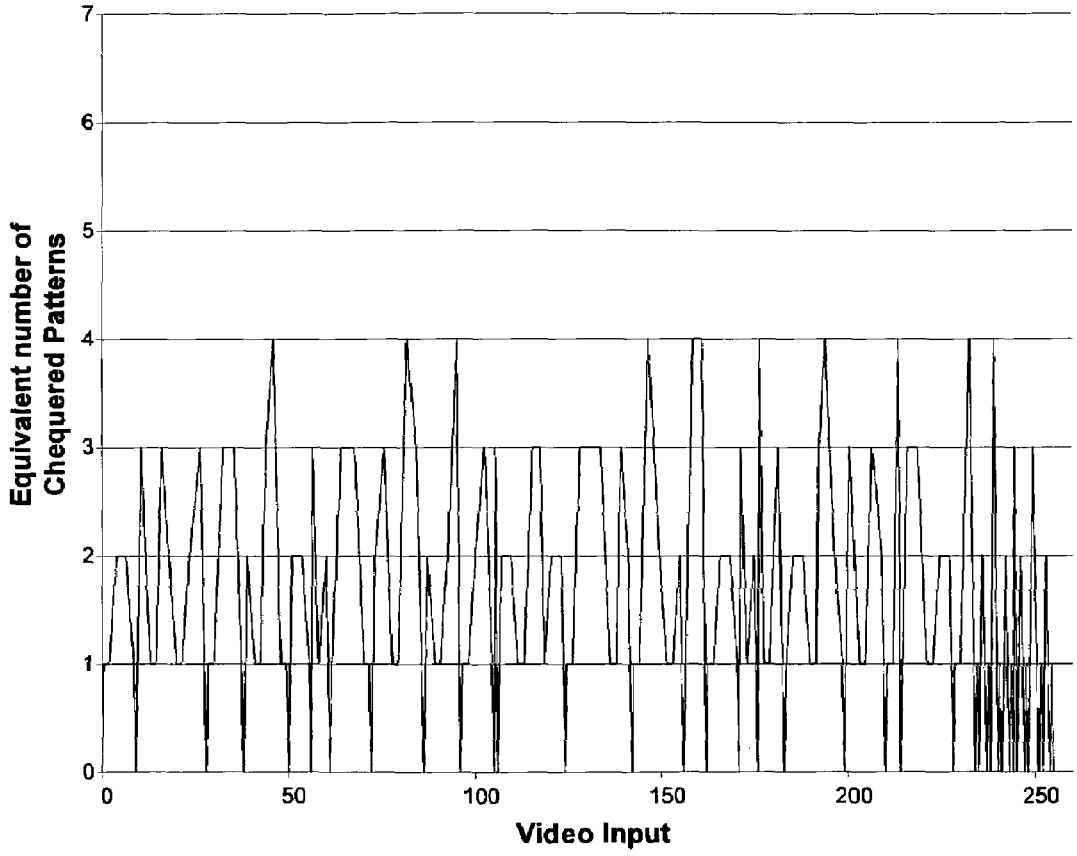
FIG. 7 shows the equivalent number of chequered patterns for every pixel value between 0 and 255 when the inventive method is applied.

Concerning driver heat, FIG. 7 shows the equivalent number of chequered patterns for every video input between 2 and 232 when the inventive method is applied. This figure is to be compared with FIG. 5 related to the standard PPC. The maximum equivalent number of chequered pattern is now reduced to 4.

The inventive method has been described for the Parallel Peak Coding, i.e. for a coding wherein the subfields are divided into two groups of subfields generating substantially the same light energy and wherein the two split pixel values are substantially equal. It can be extended to other codings wherein the subfields are divided into three or more groups of subfields generating different light energy and wherein the pixel values are thus split into three or more different split pixel values.

The circuit for implementing the inventive method is the same than the one used for implementing the standard PPC. Only the content of the look-up tables is amended. The driver heat problem is thus solved without extra costs and without loss of quality.

Figure 8:
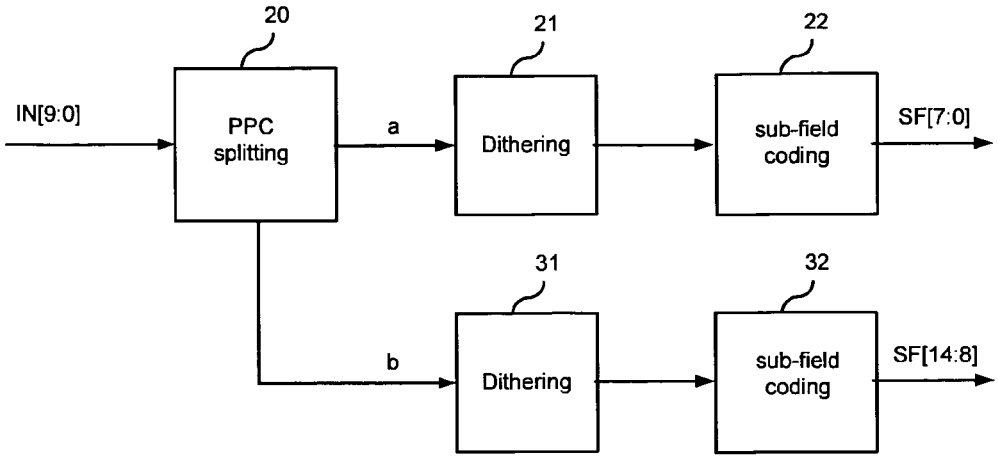
FIG. 8 shows a block diagram of a first possible circuit implementation of the inventive method.

In FIG. 8, a block diagram of a possible circuit implementation for encoding the pixel values into sub-field code word as described above is illustrated. Input R,G,B video data, IN[9:0], coming for example from a video degamma unit, are forwarded to splitting means 20 used for outputting, for each input video data, the split pixel values a and b. These means comprise for example at least two Look-Up Tables (LUTs), one for each split value. In the case of PPC, there are two LUTs, one delivering the split pixel value a and one for delivering the split pixel value b. The split pixel value a (respectively b) is then advantageously transmitted to a dithering block 21 (resp. 31) for generating, if need be, values encodable by the subfield group G1 (resp. G2) as described before. The dithered value is then forwarded to a subfield coding block 22 (resp.32) for outputting the corresponding subfield code word. This sub-field code word will be used by the display panel for driving the lighting period of the cells of the panel.

Figure 9:
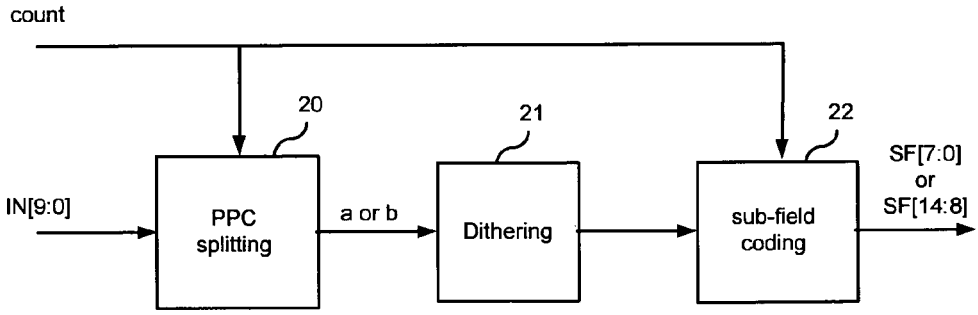
FIG. 9 shows a block diagram of a second possible circuit implementation of the inventive method.

It is also possible to use the matched Parallel Peak Code with a frame frequency twice as high. For example, instead of having a 50 Hz video input, it is also possible to have a 100 Hz video input and to use, depending on the parity of the frame (odd or even), the first or the second group of sub-fields (G1 or G2) and the corresponding encoding table. Of course, it is not limited to 100 Hz; it can also be used for other frequencies like 72, 75, 80, 85, 90 or even 120 Hz. FIG. 9 is illustrated this possibility. Count is a 1-bit counter, which is incremented at each frame. Depending on its value (0 or 1), the video is encoded with sub-field group G1 and the encoding table assigned to this first group (case 0) or with sub-field group G2 and the encoding table assigned to this second group (case 1).

The invention has been described for The Parallel Peak Coding (PPC) having a big problem of driver overheating. Of course, the principle of the inventive method can be extended to other codings using at least two groups of subfields.

The invention claimed is:

1. Method for processing video pictures data for display on a display device having a plurality of luminous elements corresponding to the pixels of a video picture, the luminous elements being organized in columns and lines, wherein the time of a video frame or field is divided into a plurality of sub-fields during which the luminous elements can be activated for light emission, a sub-field code word corresponding to said plurality of sub-fields being used for encoding the pixels values in which each bit can have either an "OFF" state or an "ON" state such that each luminous element is activated during a subfield when the corresponding bit of sub-field code word has an "ON" state, comprising:

a splitting step for splitting each pixel value of the picture to be displayed into at least first and second split pixel values, each split value being associated to a group of subfields of said plurality of subfields, a spatial dithering step for associating to each split pixel value V one dithering level L used to dither between two different pixel values $V_1$ and $V_2$ that can be coded by the associated group of subfields such that $V=(1-L)\times V_1+L\times V_2$ with $V_1<V_2$ and $L\in[0, 1]$, a coding step for coding the pixel values $V_1$ and $V_2$ into sub-field code words, each bit of the sub-field code word having a bit state, wherein the split pixel values and the dithering levels are selected such that, if the sum of the number of bits having a different state in the subfield code word of the pixel value V1 and the subfield code word of the pixel value V2 associated to the first split pixel value and the number of bits having a different state in the subfield code word of the pixel value V1 and the subfield code word of the pixel value V2 associated to the second split pixel value is greater than or equal to a first threshold, the sum of the absolute differences between the dithering level of each split pixel value and ½ is made greater than a second threshold.

2. Method according to claim 1, wherein said second threshold is greater than or equal to ¼.

3. Method according to claim 1, wherein the first threshold is zero.

4. Method according to claim 1, wherein the first threshold is different from zero.

5. Method according to claim 1, wherein the second threshold is equal to ½.

6. Method according to claim 1, wherein each pixel value of the picture to be displayed is split into two first and second split pixel values, the first and second split values being associated to first and second groups of subfields respectively.

7. Method according to claim 6, wherein the dithering level for the first split pixel value is ½ and the dithering level for the second split pixel value is 0 or the dithering level for the first split pixel value is 0 and the dithering level for the second split pixel value is ½ or the dithering level for the first and second split pixel values are different from ½.

8. Method according to claim 1, wherein the number of subfields of the first group of subfields is substantially equal to the number of subfields of the second group of subfields.

9. Method according to claim 6, wherein the first and second pixel values are substantially equal.

10. Device for processing video pictures data for display on a display device having a plurality of luminous elements corresponding to the pixels of a video picture, the luminous elements being organized in columns and lines, wherein the time of a video frame or field is divided into a plurality of sub-fields during which the luminous elements can be activated for light emission, a sub-field code word corresponding to said plurality of sub-fields being used for encoding the pixels values in which each bit can have either an "OFF" state or an "ON" state such that each luminous element is activated during a subfield when the corresponding bit of sub-field code word has an "ON" state, comprising:

splitting means for splitting each pixel value of the picture to be displayed into at least first and second split pixel values, each split value being associated to a group of subfields of said plurality of subfields, spatial dithering means for associating to each split pixel value V one dithering level L used to dither between two different pixel values $V_1$ and $V_2$ that can be coded by the associated group of subfields such that $V=(1-L)\times V_1+L\times V_2$ with $V_1<V_2$ and $L\in[0, 1]$, and coding means for coding the pixel values $V_1$ and $V_2$ into sub-field code words, each bit of the sub-field code word having a bit state, wherein the splitting means and the spatial dithering means are controlled in order that, if the sum of the number of bits having a different state in the subfield code word of the pixel value V1 and the subfield code word of the pixel value V2 associated to the first split pixel value and the number of bits having a different state in the subfield code word of the pixel value V1 and the subfield code word of the pixel value V2 associated to the second split pixel value is greater than or equal to a first threshold, the sum of the absolute differences between the dithering level of each split pixel value and ½ is made greater than a second threshold.

* * * * *